US007391852B2

(12) United States Patent
Anno et al.

(10) Patent No.: US 7,391,852 B2
(45) Date of Patent: Jun. 24, 2008

(54) X-RAY APPARATUS

(75) Inventors: Hidero Anno, Otawara (JP); Koichi Kitade, Otawara (JP); Takayuki Kitami, Nasu-gun (JP); Hironori Nakamuta, Otawara (JP); Manabu Sato, Nasu-gun (JP)

(73) Assignees: Kabushiki Kaisha Toshiba, Tokyo (JP); Toshiba Electron Tubes & Devices, Tokyo (JP)

( * ) Notice: Subject to any disclaimer, the term of this patent is extended or adjusted under 35 U.S.C. 154(b) by 0 days.

(21) Appl. No.: 11/401,300

(22) Filed: Apr. 11, 2006

(65) Prior Publication Data

US 2006/0182222 A1 Aug. 17, 2006

Related U.S. Application Data

(63) Continuation of application No. PCT/JP2004/015388, filed on Oct. 18, 2004.

(30) Foreign Application Priority Data

Oct. 17, 2003 (JP) ..... 2003-358277

(51) Int. Cl.
*H01J 35/02* (2006.01)

(52) U.S. Cl. ..... 378/130; 378/125

(58) Field of Classification Search ..... 378/130, 378/119–148; 257/329, E29.118; 438/212
See application file for complete search history.

(56) References Cited

U.S. PATENT DOCUMENTS

| | | | | |
|---|---|---|---|---|
| 4,880,051 | A * | 11/1989 | Ohashi | 165/45 |
| 6,314,161 | B1 * | 11/2001 | Anno | 378/125 |
| 6,519,317 | B2 | 2/2003 | Richardson et al. | |
| 6,594,340 | B2 * | 7/2003 | Saito | 378/130 |
| 6,751,292 | B2 * | 6/2004 | Andrews et al. | 378/132 |
| 2002/0097838 | A1 * | 7/2002 | Saito | 378/130 |
| 2002/0146092 | A1 * | 10/2002 | Richardson et al. | 378/130 |

FOREIGN PATENT DOCUMENTS

| | | |
|---|---|---|
| JP | 2001-502473 | 2/2001 |
| JP | 2002-216683 | 8/2002 |
| JP | 2003-197136 | 7/2003 |

* cited by examiner

*Primary Examiner*—Hoon Song
(74) *Attorney, Agent, or Firm*—Pillsbury Winthrop Shaw Pittman, LLP

(57) ABSTRACT

An X-ray apparatus includes a rotation-anode type X-ray tube which is configured such that a rotatable anode target and a cathode that is disposed to be opposed to the anode target are accommodated within a vacuum envelope, a stator which generates an induction electromagnetic field for rotating the anode target, a housing which accommodates and holds at least the rotation-anode type X-ray tube, a circulation path which is provided near at least a part of the rotation-anode type X-ray tube, and through which a water-based coolant is circulated, and a cooling unit including a circulation pump, which is provided at a position along the circulation path and forcibly feeds the water-based coolant, and a radiator which radiates heat of the water-based coolant, wherein at least a part of a surface of a metallic component is coated with a coating member to prevent contacting with the water-based coolant.

2 Claims, 7 Drawing Sheets

X-RAY APPARATUS

CROSS REFERENCE TO RELATED APPLICATIONS

This is a Continuation Application of PCT Application No. PCT/JP2004/015388, filed Oct. 18, 2004, which was published under PCT Article 21(2) in Japanese.

This application is based upon and claims the benefit of priority from prior Japanese Patent Application No. 2003-358277, filed Oct. 17, 2003, the entire contents of which are incorporated herein by reference.

BACKGROUND OF THE INVENTION

1. Field of the Invention

The present invention relates to an X-ray apparatus, and more particular to an X-ray apparatus with improved heat radiation characteristics relating to heat that is produced by, e.g. a rotation-anode type X-ray tube.

2. Description of the Related Art

An X-ray apparatus is configured to include a rotation-anode type X-ray tube in which a vacuum envelope accommodates an anode target that is rotatably supported, and a housing which accommodates the rotation-anode type X-ray tube. In a case where heat that is produced by, e.g. the anode target is to be radiated, the rotation-anode type X-ray tube is provided with a cooling mechanism for cooling the heat.

As regards X-ray apparatuses with cooling mechanisms, the following proposals have been made.

(1) An X-ray apparatus has been proposed, wherein a rotation-anode type X-ray tube and a stator are immersed in an insulating oil. A water-based coolant with a high heat transfer efficiency is made to flow through flow paths, which are partly provided at parts with high heat production, such as a recoil electron trap and a vacuum envelope provided near an anode target. Thereby, the parts with high heat production are cooled. The coolant is circulated between these flow paths and a cooling unit (see, e.g. U.S. Pat. No. 6,519,317).

(2) An X-ray apparatus has been proposed, which is constructed similarly to the X-ray apparatus (1), except that a rotation-anode type X-ray tube and a stator are immersed not in an insulating oil, but in a water-based coolant, and the water-based coolant is circulated between a housing and a cooling unit (see, e.g. PCT National Publication No. 2001-502473).

According to the X-ray apparatus with the structure (1), if the thermal load on the rotation-anode type X-ray tube increases, the heat that is produced from the outer surface of the vacuum envelope increases. However, since the coolant that cools the outer surface is only the insulating oil that is not cooled by the external heat exchanger. In some cases, the necessary cooling performance cannot be obtained. In addition, since the coolant contains water, metallic parts of the circulation paths may be corroded. The metallic parts, which constitute the flow paths that are partly provided at the recoil electron trap and vacuum envelope provided near the anode target, have functions to isolate the vacuum and the coolant. If corrosion progresses, such functions would deteriorate and the X-ray tube would become non-usable. If such a drawback occurs, the water-based coolant may enter the X-ray tube when the temperature of the anode target of the X-ray tube rises to a high level. The water-based coolant comes in contact with the high-temperature anode target, evaporates and raises pressure. This poses a problem in safety.

In addition to the problem of the structure (1), the X-ray apparatus with the structure (2) has the following problem. That is, with the decrease in insulation resistance value of the water-based coolant due to the metal corrosion, the insulation performance of a low-voltage electric circuit system, such as a stator circuit, and the insulation performance between the housing and vacuum envelope may deteriorate. In particular, in the case where a dynamic-pressure slide bearing is used as the bearing of the rotational support mechanism, compared to the case where a ball bearing is used, the heat production of the stator increases and the electric insulation performance considerably deteriorates. In addition, the vacuum wall of the X-ray tube, which is not immersed in the water-based coolant in the case of (1), is corroded. As a result, a similar problem with the structure (1) tends to occur more easily.

BRIEF SUMMARY OF THE INVENTION

The present invention has been made in consideration of the above-described problems, and the object of the invention is to provide an X-ray apparatus which can improve heat radiation characteristics and can have high reliability for a long time.

According to an aspect of the invention, there is provided an X-ray apparatus characterized by comprising:

a rotation-anode type X-ray tube which is configured such that a rotatable anode target and a cathode that is disposed to be opposed to the anode target are accommodated within a vacuum envelope;

a stator which generates an induction electromagnetic field for rotating the anode target;

a housing which accommodates and holds at least the rotation-anode type X-ray tube;

a circulation path which is provided near at least a part of the rotation-anode type X-ray tube, and through which a water-based coolant is circulated; and a cooling unit including a circulation pump, which is provided at a position along the circulation path and forcibly feeds the water-based coolant, and a radiator which radiates heat of the water-based coolant, wherein at least a part of a surface of a metallic component is coated with a coating member to prevent contacting with the water-based coolant.

DETAILED DESCRIPTION OF THE INVENTION

X-ray apparatuses according to embodiments of the present invention will now be described with reference to the accompanying drawings.

First Embodiment

Figure 1:
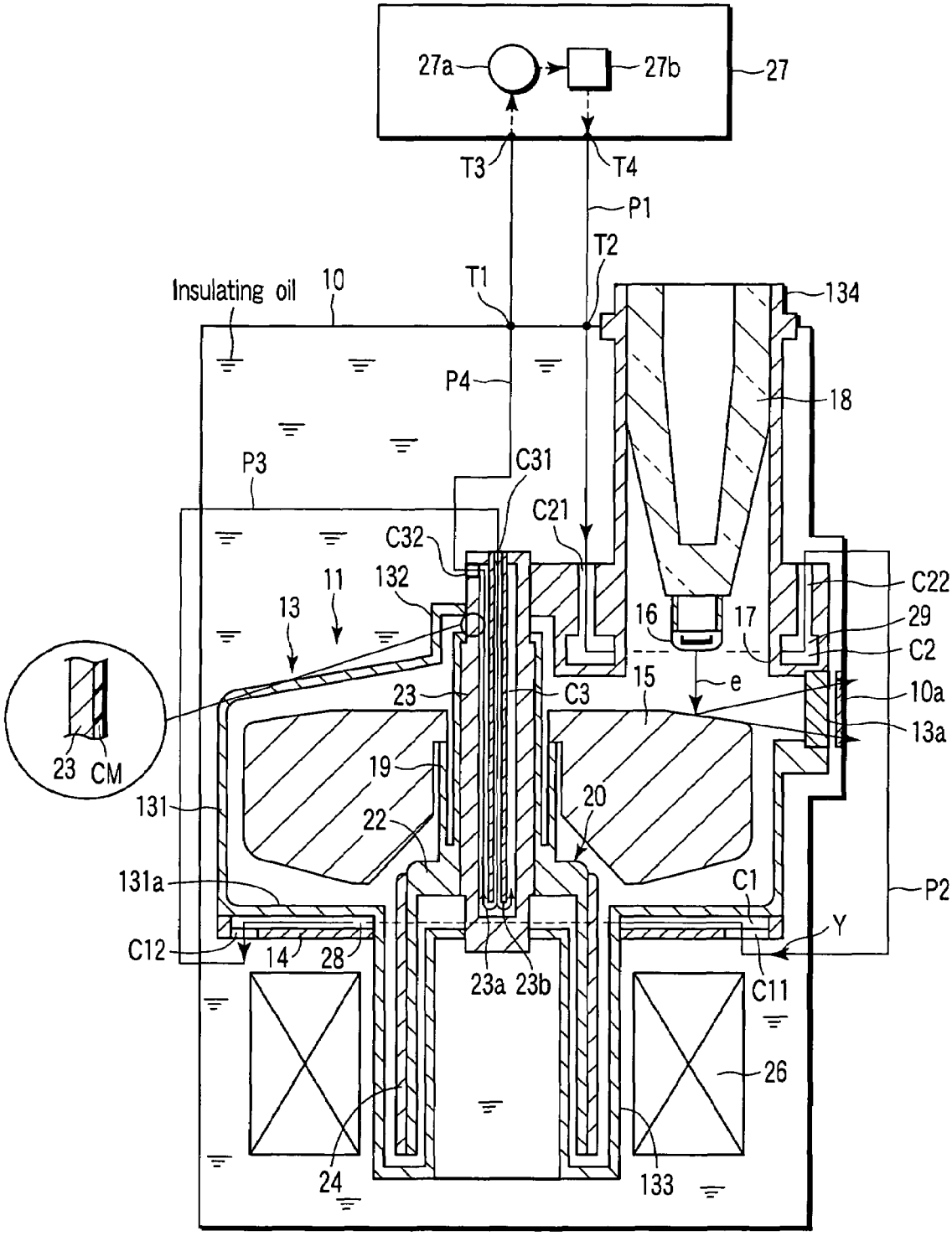
FIG. 1 schematically shows the structure of an X-ray apparatus according to a first embodiment of the present invention.

As is shown in FIG. 1, an X-ray apparatus according to a first embodiment includes a housing 10 and a rotation-anode type X-ray tube 11. The housing 10 has an X-ray output window 10*a* provided at a part thereof. The rotation-anode type X-ray tube 11 is accommodated and held within the housing 10. The housing 10 contains a non-water-based coolant, such as an insulating oil, that fills its inner space accommodating the rotation-anode type X-ray tube 11.

The rotation-anode type X-ray tube 11 is composed of a vacuum envelope 13, etc. The vacuum envelope 13 has an X-ray output window 13*a* provided at a part thereof. The vacuum envelope 13 is composed of, for example, a large-diameter portion 131, a small-diameter portion 132 with a less diameter than the large-diameter portion 131, a double-cylindrical portion 133 and a cylindrical cathode-containing portion 134. The large-diameter portion 131, small-diameter portion 132 and cylindrical portion 133 are provided coaxial with the tube axis. The cathode-containing portion 134 is provided eccentric to the tube axis.

A rotatable anode target 15 is disposed in the large-diameter portion 121. A cathode 16 is disposed in the cathode-containing portion 134 so as to face the anode target 15. A recoil electron trap (shield structure) 17 is provided at a part of the cathode-containing portion 134, for example, at a wall part that is so disposed as to surround the cathode 16. The recoil electron trap 17 captures electrons which are reflected from the anode target 15. The recoil electron trap 17 is formed of a material with a relatively high heat conductivity, such as copper or a copper alloy.

The cathode 16 is supported by a cathode support structure 18. The cathode support structure 18 is fixed to the inside of the cathode-containing portion 134. The anode target 15 is coupled to a rotational support mechanism 20 via a coupling portion 19, and is rotatably supported by the rotational support mechanism 20.

The rotational support mechanism 20 comprises a rotary member 22, which is coupled to the coupling portion 19, and a stationary member 23 which is fitted, for example, in a distal-end portion of the rotary member 22. A cylindrical rotor 24 is coupled to an outer peripheral surface of a rear-end cylindrical portion of the rotary member 22. A dynamic-pressure slide bearing, for instance, a radial-directional/thrust-directional dynamic-pressure slide bearing (not shown), is provided at an engaging part between the rotary member 22 and stationary member 23. Both end portions of the stationary member 23 are fixed to the vacuum envelope 13.

A stator 26 is disposed outside the vacuum envelope 13, for example, at such a position as to surround the cylindrical rotor 24. The stator 26 generates an induction electromagnetic field for rotating the anode target 15. The stator 26, together with the rotation-anode type X-ray tube 11, is accommodated within the housing 10 and is put in contact with the insulating oil.

A cooling unit 27 is provided, for example, outside the housing 10. The cooling unit 27 comprises, for example, a circulation pump 27*a* and a heat exchanger 27*b*. The circulation pump 27*a* is provided at a point on a circulation path through which a water-based coolant (to be described later) is circulated. The circulation pump 27*a* forcibly feeds the water-based coolant. The heat exchanger (radiator) 27*b* is provided on a downstream side of the circulation pump 27*a* and radiates heat of the water-based coolant. The radiator is formed of a material with a relatively high heat conductivity, such as copper or a copper alloy. The water-based coolant is, for instance, is a coolant with a higher heat conductivity than the insulating oil in the housing 10, such as a mixture of water and ethylene glycol or propylene glycol (hereinafter referred to as "antifreeze liquid"). The water-based coolant is filled in the circulation path.

The circulation path of the water-based coolant is provided in the vicinity of at least a part of the rotation-anode type X-ray tube 11. The circulation path includes a first cooling path C1, a second cooling path C2 and a third cooling path C3. The first cooling C1 is formed on the cylindrical portion 133 side of the large-diameter portion 131, that is, under the large-diameter portion 131. The second cooling path C2 is formed near or within the recoil electron trap 17. The third cooling path C3 is formed within the stationary member 23.

Specifically, on the outside of a wall 131*a* located on the cylindrical portion 133 side of the large-diameter portion 131, an annular wall 14 is so provided as to be in parallel to the wall 131*a* and to surround the cylindrical portion 133. The first cooling path C1 is a discoidal space 28 provided between the wall 131*a* and the wall portion 14. The discoidal space 28 includes an inlet C11 for introducing the water-based coolant into the first cooling path C1, and an outlet C12 for draining the water-based coolant from the first cooling path C1. The inlet C11 and outlet C12 are formed, for example, at both ends of the discoidal space 28 with respect to the center of the discoidal space 28 (i.e. at a distance of 180°).

The second cooling path C2 is, for instance, an annular space 29 within the recoil electron trap 17. The annular space 29 includes an inlet C21 for introducing the water-based coolant into the second cooling path C2, and an outlet C22 for draining the water-based coolant from the second cooling path C2.

The third cooling path C3 is formed of, for instance, a cavity 23*a* which is formed within the stationary member 23, and a pipe 23*b* which is inserted in the cavity 23*a*. Specifically, the stationary member 23 is a hollow rod-like member having one end portion (on the cathode-containing portion 134 side in this example) opened, and the other end portion (on the cylindrical rotor 24 side in this example) closed. The pipe 23*b* is fixed at the rotational center of the cylindrical rotor 24. One end of the pipe 23*b*, which corresponds to the above-mentioned one end portion of the stationary member 23, serves as an inlet C31 for introducing the water-based coolant into the third cooling path C3. The above-mentioned one end portion of the stationary member 23 serves as an outlet C32 for draining the water-based coolant from the third cooling path C3. To be more specific, the water-based coolant, which is introduced from the inlet C31, flows through the pipe 23*b* and turns in a U-shape within the cavity 23*a*, and then the water-based coolant is drained from the outlet C32 to the outside of the stationary member 23.

Pipes P1, P2, P3 and P4 connect, respectively, the cooling unit 27 and inlet C21, the outlet C22 and inlet C11, the outlet C12 and inlet C31, and the outlet C32 and cooling unit 27. Thereby, the circulation path including the first cooling path C1, second cooling path C2 and third cooling path C3 is formed. For the convenience of depiction, the pipes P2 and P3 are partly depicted on the outside of the housing 10. Normally, however, the pipes P2 and P3 are provided within the housing 10.

The cooling unit 27 is connected to the housing 10 via detachable piping joints. Specifically, circulation paths between the housing 10 and cooling unit 27 are formed of, e.g. hoses. Connection parts T1 and T2 between the hoses and the housing 10 and connection parts T3 and T4 between the hoses and the cooling unit 27 are configured such that at least the connection parts on the housing 10 side or the connection parts on the cooling unit 27 side are detachable. With this structure, the housing 10 and the cooling unit 27 can be separated, and the work for installing the cooling unit 27 and the work for maintenance are made easier.

In the X-ray apparatus with the above-described structure, the rotary member 22 is rotated by an induction electromagnetic field that is generated by the stator 26. The rotational force is transmitted to the anode target 15 via the coupling portion 19, and the anode target 15 is rotated. In this state, an electron beam e is radiated from the cathode 16 to the anode target 15, and the anode target 15 emits X-rays. The X-rays are extracted to the outside via the X-ray output windows 13*a* and 10*a*. At this time, part of the electron beam e, which is reflected by the anode target 15, is captured by the recoil electron trap 17.

If the rotation-anode type X-ray tube 11 is set in operation, the temperature of the anode target 15 rises due to the irradiation with the electron beam e. The temperature of the recoil electron trap 17 also rises due to the capture of the reflective electron beam e from the anode target 15. Further, the temperature of the stator 26 rises due to electric current flowing in the coil section. By the transfer of the heat, the temperature of the vacuum envelope 13 rises.

The heat of the vacuum envelope 13 and stator 26 is transferred to the insulating oil within the housing 10 and thus radiated to the outside. The heat of the anode target 15 and recoil electron trap 17 is transferred to the antifreeze liquid circulating in the circulation path and is radiated to the outside. Specifically, the circulation pump 27*a* of the cooling unit 27 circulates the antifreeze liquid in the circulation path, as indicated by an arrow Y in the Figure. The heat exchanger 27*b* radiates heat of the antifreeze liquid, which is forcibly fed from the circulation pump 27*a* and has the temperature raised by cooling the rotation-anode type X-ray tube 11.

The antifreeze liquid, which is fed out of the heat exchanger 27*b* of the cooling unit 27, is introduced into the inlet C21 via the pipe P1 and cools the recoil electron trap 17 while passing through the annular space 29 (second cooling path C2). The antifreeze liquid coming out of the outlet C22 is introduced into the inlet C11 via the pipe P2 and cools the large-diameter portion 131 of the vacuum envelope 13 while passing through the discoidal space 28 (first cooling path C1).

The antifreeze liquid drained from the outlet C12 is introduced into the inlet C31 via the pipe P3 and cools the stationary member 23 while passing through the cavity 23*a* (third cooling path C3) that is so formed as to permit reciprocal flow of the antifreeze liquid within the stationary member 23. The antifreeze liquid coming out of the outlet C32 is returned to the cooling unit 27 via the pipe P4.

In the meantime, at least a part of the surface of metallic components is coated with a coating member to prevent contacting with the water-based coolant. In the first embodiment, the metallic components that come in contact with the water-based coolant are those constituting the circulation path, for instance, the circulation pump 27*a*, heat exchanger 27*b*, pipes P1 to P4, cooling paths C1 to C3, and connection parts T1 to T4. At least a part of the inner surface thereof is coated with a coating member.

In the case where a coating member is directly formed on a metallic component, the coating member is fixed to the surface of the metallic component with no gap. In the case where a coating member is indirectly formed on a metallic component, there are two possible states: one in which an intermediate coating lies between the metallic component and the coating member in order to increase adhesion therebetween, and the other state in which the metallic component and the coating member are simply put in contact with each other, with a gap being provided therebetween. For example, a bag-like member, which surrounds the part that is in contact with the water-based coolant, may be used to function as the coating member.

The coating member functions as an anti-rust coating film for the metallic component, or functions as an electrical insulation film. Specifically, the coating member is formed of, e.g. an organic coating. To be more specific, the organic coating is a coating film formed of one selected from an epoxy resin, a tar epoxy resin, a polyimide resin, an acrylic resin, a fluorocarbon resin, a silicone resin, a polyurethane resin, a polyamide resin, an unsaturated polyester resin and a polyvinyl chloride resin, or a mixture resin essentially comprising with at least one of these mentioned resins.

Alternatively, the coating member may be formed of an inorganic coating. To be more specific, it is preferable that the coating member be formed of one selected from a ceramics coating, a fluoride coating, an oxide coating and a metal-plating coating. In the case of the metal-plating coating, it is preferable that the principal constituent thereof be one selected from gold, silver, chromium, nickel, tin, and platinum.

In the first embodiment, as shown in FIG. 1, for example, that part of the stationary member 23 having the third cooling path C3, which is in contact with the water-based coolant, is coated with a coating member CM. The stationary member 23 is formed of, e.g. an iron-nickel alloy, and an epoxy resin coating (e.g. "Hi-PON 40" manufactured by Nippon Paint Co., Ltd.) can be chosen as the coating member CM that is coated on the stationary member 23. Anti-corrosion properties are further improved if a silicone resin coating (e.g. "PL-250" manufactured by Yugen-Kaisha Pilex) is formed as an under-coating of the epoxy resin coating.

According to the X-ray apparatus of the first embodiment, the heat of the parts, the temperature of which rises to a high level, such as parts of the recoil electron trap 17 and vacuum envelope 13, is efficiently radiated by the antifreeze liquid with high thermal transfer efficiency, which flows through the first cooling path C1, second cooling path C2 and third cooling path C3. At the large-diameter portion 131, heat exchange is performed between the antifreeze liquid flowing in the first cooling path C1 and the insulating oil. In this case, the insulating oil moves while being in contact with the outer surface of the wall portion 14, and thus efficient heat exchange is performed with the antifreeze liquid and the characteristics of heat radiation by the insulating oil are improved. As a result, there is no need to provide a heat exchanger for the insulating oil, and the structure of the apparatus is simplified.

Furthermore, the outer periphery of the stator 26, the outer surface of the vacuum envelope 13 and the inner surface of the housing 10 are not in contact with the water-based coolant, and the insulating oil flow along them. It is thus possible to prevent a decrease in electrical insulation and corrosion of metal. Moreover, the metallic components, which are in contact with the water-based coolant (antifreeze liquid) having high heat transfer efficiency, have anti-rust coating films. It is thus possible to prevent corrosion of metallic components along the circulation path.

Therefore, it is possible to provide an X-ray apparatus which can secure good heat radiation characteristics and high reliability for a long time.

Second Embodiment

An X-ray apparatus according to a second embodiment of the present invention is described. The structural parts common to those in the first embodiment are denoted by like reference numerals, and a detailed description is omitted.

Figure 2:
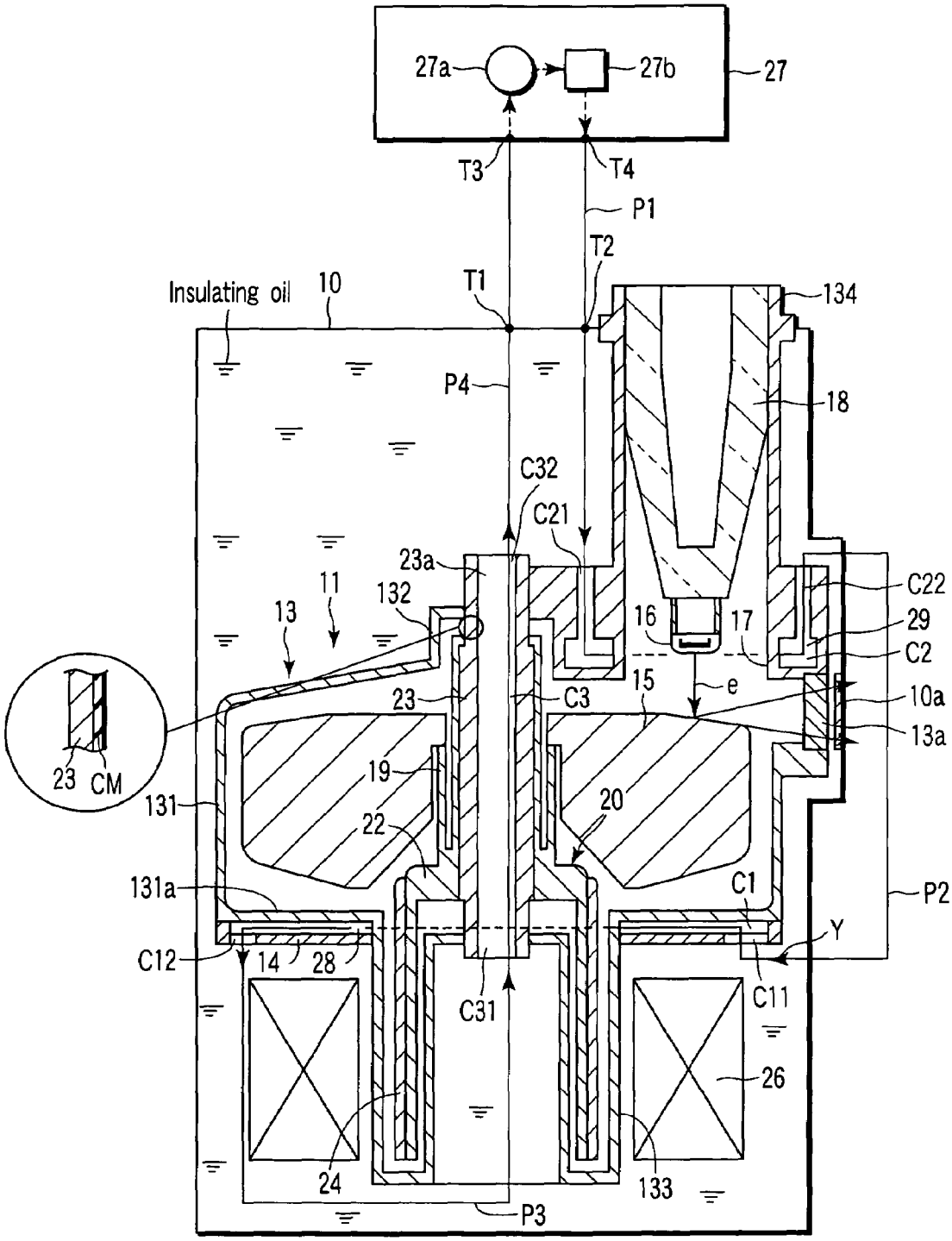
FIG. 2 schematically shows the structure of an X-ray apparatus according to a second embodiment of the invention.

As is shown in FIG. 2, the third cooling path C3 is formed, for example, by a through-hole 23*a* that linearly penetrates the stationary member 23. The stationary member 23 is a hollow rod-like member, and has both ends opened. The through-hole 23*a* includes an inlet C31 for introducing the water-based coolant into the third cooling path C3, and an outlet C32 for draining the water-based coolant from the third cooling path C3. The inlet C31 is provided at the above-mentioned other end portion (on the cylindrical rotor 24 side in this example) of the stationary member 23. The outlet C32 is provided at the above-mentioned one end portion (on the cathode-containing portion 134 side in this example) of the stationary member 23.

Pipes P1, P2, P3 and P4 connect, respectively, the cooling unit 27 and inlet C21, the outlet C22 and inlet C11, the outlet C12 and inlet C31, and the outlet C32 and cooling unit 27. Thereby, the circulation path including the first cooling path C1, second cooling path C2 and third cooling path C3 is formed. For the convenience of depiction, the pipe P2 is partly depicted on the outside of the housing 10. Normally, however, all the pipes are provided within the housing 10.

The X-ray apparatus with the above-described structure is configured such that the antifreeze liquid coming out of the outlet C12 is introduced into the inlet C31 via the pipe P3 and cools the stationary member 23 while passing through the through-hole 23*a* (third cooling path C3) that extends within the stationary member 23 in one direction (i.e. direction from the cylindrical rotor 24 side toward the cathode-containing portion 134 side).

In the second embodiment, too, at least a part of the surface of metallic components is coated with a coating member to prevent contacting with the water-based coolant. In the second embodiment, the metallic components that come in contact with the water-based coolant are those constituting the circulation path, like the first embodiment, for instance, the circulation pump 27*a*, heat exchanger 27*b*, pipes P1 to P4, cooling paths C1 to C3, and connection parts T1 to T4. At least a part of the inner surface thereof is coated with a coating member. As in the first embodiment, the coating member can be formed of an organic coating or an inorganic coating. Therefore, according to the X-ray apparatus of the second embodiment, the same advantages as with the first embodiment can be obtained.

Third Embodiment

An X-ray apparatus according to a third embodiment of the present invention is described. The structural parts common to those in the first embodiment are denoted by like reference numerals, and a detailed description is omitted.

Figure 3:
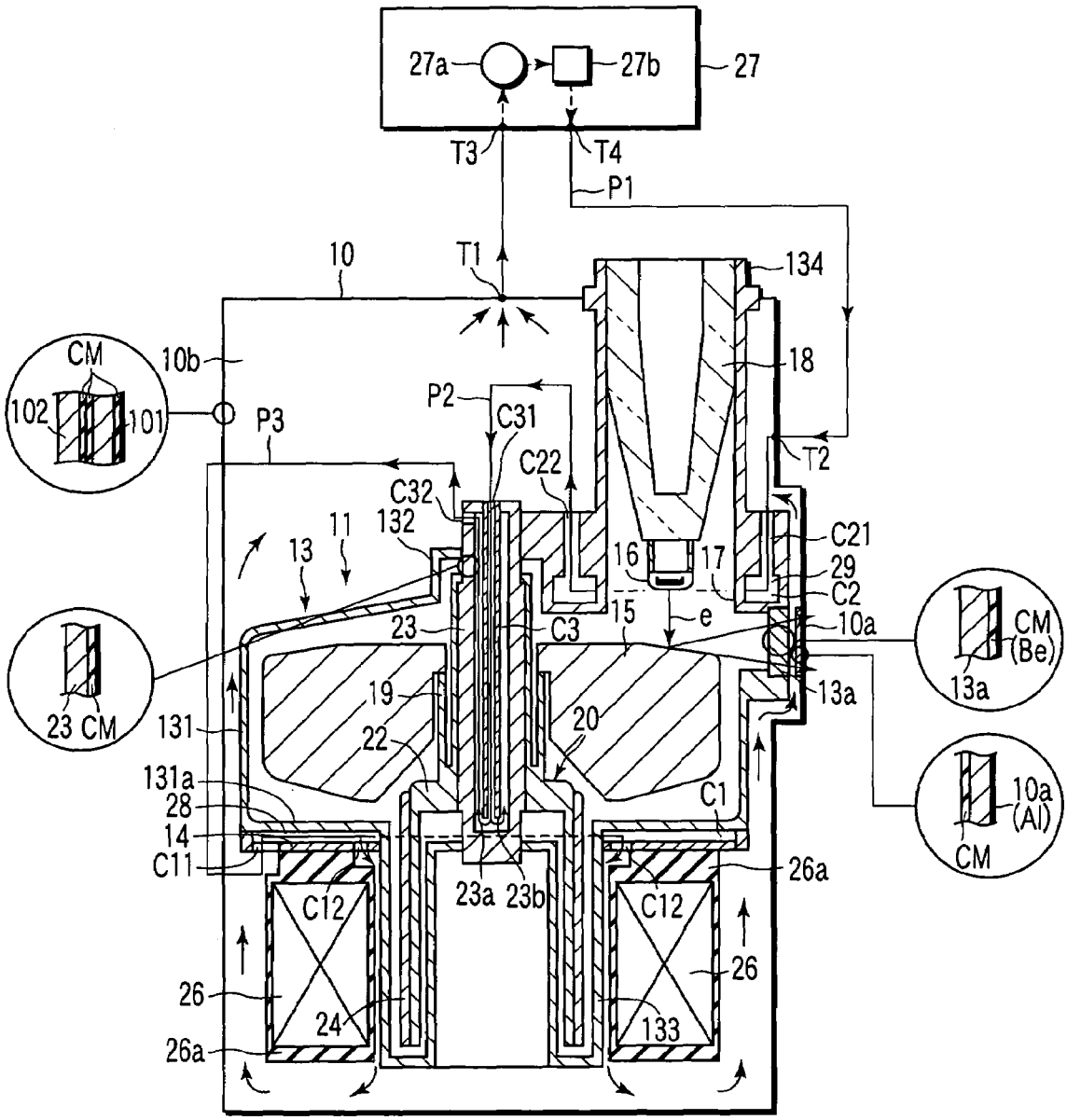
FIG. 3 schematically shows the structure of an X-ray apparatus according to a third embodiment of the invention.

As is shown in FIG. 3, like the first embodiment, the third cooling path C3 is formed of, for instance, a cavity 23*a* which is formed within the stationary member 23, and a pipe 23*b* which is inserted in the cavity 23*a*. Specifically, an inlet C31 for introducing the water-based coolant into the third cooling path C3 and an outlet C32 for draining the water-based coolant from the third cooling path C3 are both provided at one end portion of the stationary member 23 (on the cathode-containing portion 134 side in this example).

Pipes P1, P2 and P3 connect, respectively, the cooling unit 27 and inlet C21, the outlet C22 and inlet C31, and the outlet C32 and inlet C11. The outlet C12 drains the antifreeze liquid, which is introduced into the first cooling path C1, into an inner space 10*b* of the housing 10. The connection part T1 between the hose and the housing 10 functions as an outlet for outputting the antifreeze liquid from the inner space 10*b* of the housing 10 to the cooling unit 27 via the hose.

A return path of the antifreeze liquid is formed between the inner space 10*b* of the housing 10 and the cooling unit 27 (i.e. between the connection parts T1 and T3). Thus, the inner space 10*b*, which accommodates the rotation-anode type X-ray tube 11, is filled with the antifreeze liquid that is the water-based coolant.

A circulation path of the antifreeze liquid is so formed as to include the pipes P1, P2 and P3, the first cooling path C1, second cooling path C2, third cooling path C3, and the return path. For the convenience of depiction, the pipes P1 and P3 are partly depicted on the outside of the housing 10. Normally, however, the pipes P1 and P3 are provided within the housing 10.

On the other hand, the stator 26, together with the rotation-anode type X-ray tube 11, is accommodated within the housing 10. Since the stator 26 is put in contact with the water-based coolant, a coating member film 26*a* is formed (by molding) on at least a part of the stator 26.

The coating member 26*a* is formed of, e.g. an organic coating. To be more specific, the organic coating is formed of a thick coating film of a resin selected from an epoxy resin, a tar epoxy resin, a polyimide resin, an acrylic resin, a fluoro-resin, a silicone resin and a polyurethane resin, or a mixture resin essentially comprising this resin.

Thereby, the periphery of the stator 26 does not come in contact with the water-based coolant, and degradation in electrical insulation can be prevented.

In the X-ray apparatus with the above-described structure, the heat of the vacuum envelope 13, stator 26, anode target 15 and recoil electron trap 17 is transferred to the antifreeze liquid circulating in the circulation path and is radiated to the outside. Specifically, the circulation pump 27*a* of the cooling unit 27 circulates the antifreeze liquid in the circulation path, as indicated by an arrow Y in the Figure. The heat exchanger 27*b* radiates heat of the antifreeze liquid, which is forcibly fed from the circulation pump 27*a* and has the temperature raised by cooling the rotation-anode type X-ray tube 11.

The antifreeze liquid, which is fed out of the heat exchanger 27*b* of the cooling unit 27, is introduced into the inlet C21 via the pipe P1 and cools the recoil electron trap 17 while passing through the annular space 29 (second cooling path C2). The antifreeze liquid coming out of the outlet C22 is introduced into the inlet C31 via the pipe P2 and cools the stationary member 23 while passing through the cavity 23*a* (third cooling path C3) that is so formed as to permit reciprocal flow of the antifreeze liquid within the stationary member 23.

The antifreeze liquid coming out of the outlet C32 is introduced into the inlet C11 via the pipe P3 and cools the large-diameter portion 131 of the vacuum envelope 13 while passing through the discoidal space 28 (first cooling path C1). The antifreeze liquid drained from the outlet C12 is led into the inner space 10*b* of the housing 10, and cools the vacuum envelope 13 and stator 26. The antifreeze liquid in the inner space 10*b* is returned to the cooling unit 27 via the connection part T1.

In the third embodiment, too, at least a part of the surface of metallic components is coated with a coating member to prevent contacting with the water-based coolant. In the third embodiment, the metallic components that come in contact with the water-based coolant are those constituting the circulation path, for instance, the circulation pump 27*a*, heat exchanger 27*b*, pipes P1 to P4, cooling paths C1 to C3, connection parts T1 to T4, the inner surface of the housing 10, the outer surface of the vacuum envelope 13, X-ray output window 10*a* and X-ray output window 13*a*. At least a part thereof is coated with a coating member. As in the first embodiment, the coating member CM can be formed of an organic coating or an inorganic coating.

For example, the housing 10 has a double-layer structure comprising a first layer 101, which is formed of lead, and a second layer 102 which is formed of cast aluminum and covers the outside of the first layer 101. Preferably, the entire surfaces (inner and outer surfaces) of the first layer 101 should be coated in advance with the coating member CM. At least the inner surface of the second layer 102 is coated with the coating member CM. The first layer 101 and second layer 102 are coupled to each other via an adhesive. An epoxy denatured resin coating (e.g. "Hi-PON 30HB" manufactured by Nippon Paint Co., Ltd.) can be chosen as the coating member CM for coating the first layer 101 and second layer 102. Anti-corrosion properties are further improved if a silicone resin coating (e.g. "PL-250" manufactured by Yugen-Kaisha Pilex) is formed as an under-coating of the epoxy denatured resin coating.

An epoxy resin coating (e.g. "Hi-PON 40" manufactured by Nippon Paint Co., Ltd.) can be chosen as the coating member CM for coating the surface of the iron-nickel alloy of, e.g. the vacuum envelope 13 or a nickel-plated surface thereon. Anti-corrosion properties are further improved if a silicone resin coating (e.g. "PL-250" manufactured by Yugen-Kaisha Pilex) is formed as an under-coating of the epoxy resin coating.

A polyimide coating (e.g. "U-VARNISH-A" or "U-VARNISH-S" manufactured by Ube Industries, Ltd.) can be chosen as the coating member CM for coating the inner surface of the X-ray output window 10*a* that is formed of aluminum.

A polyimide coating (e.g. "U-VARNISH-A" or "U-VARNISH-S" manufactured by Ube Industries, Ltd.) can be chosen as the coating member CM for coating the surface of the X-ray output window 13*a* that is formed of beryllium.

According to the X-ray apparatus of the third embodiment, the same advantageous effects as with the first embodiment can be obtained. In addition, since the coolant to be used is only the water-based coolant, this is advantageous in terms of cost, and the maintenance is easy. Since the water-based coolant has a higher heat transfer efficiency than the insulating oil, the heat radiation characteristics of the entire apparatus can further be improved. Moreover, the anti-corrosion properties of the metallic parts that are in contact with the water-based coolant are improved, and the electrical insulation properties are enhanced. For the purpose of reference, the electrical resistance value (Ω) between the housing 10 and vacuum envelope 13 was measured.

In the case where no coating is formed on the inner surface of the housing 10, the electrical resistance value between both components was 1 kΩ or less, and the electrical insulation was insufficient. In the case where the housing 10 was formed such that the first layer 101 and second layer 102, which are not coated with coating members, are attached to each other and then the inner surface of the first layer 101 is coated three times with coating members CM, the electrical resistance value between both components was in a range of 1 MΩ to 10 kΩ, and the electrical insulation was not considered sufficient.

By contrast, as has been described in connection with the third embodiment, the housing 10 was formed such that the second layer 102, both the inner and outer surfaces of which were coated with coating members CM, was attached to the first layer 101 having the inner surface coated with the coating member CM, and the inner surface of the first layer 101 was further coated two times with coating members CM. In this case, the electrical resistance value between the housing 10 and vacuum envelope 13 was 20 MΩ or more, and a sufficient electrical insulation was secured. The electrical conductivity of the water-based coolant, which was used in this case, was 1 to 2 mS/m.

Fourth Embodiment

An X-ray apparatus according to a fourth embodiment of the present invention is described. The structural parts common to those in the third embodiment are denoted by like reference numerals, and a detailed description is omitted.

Figure 4:
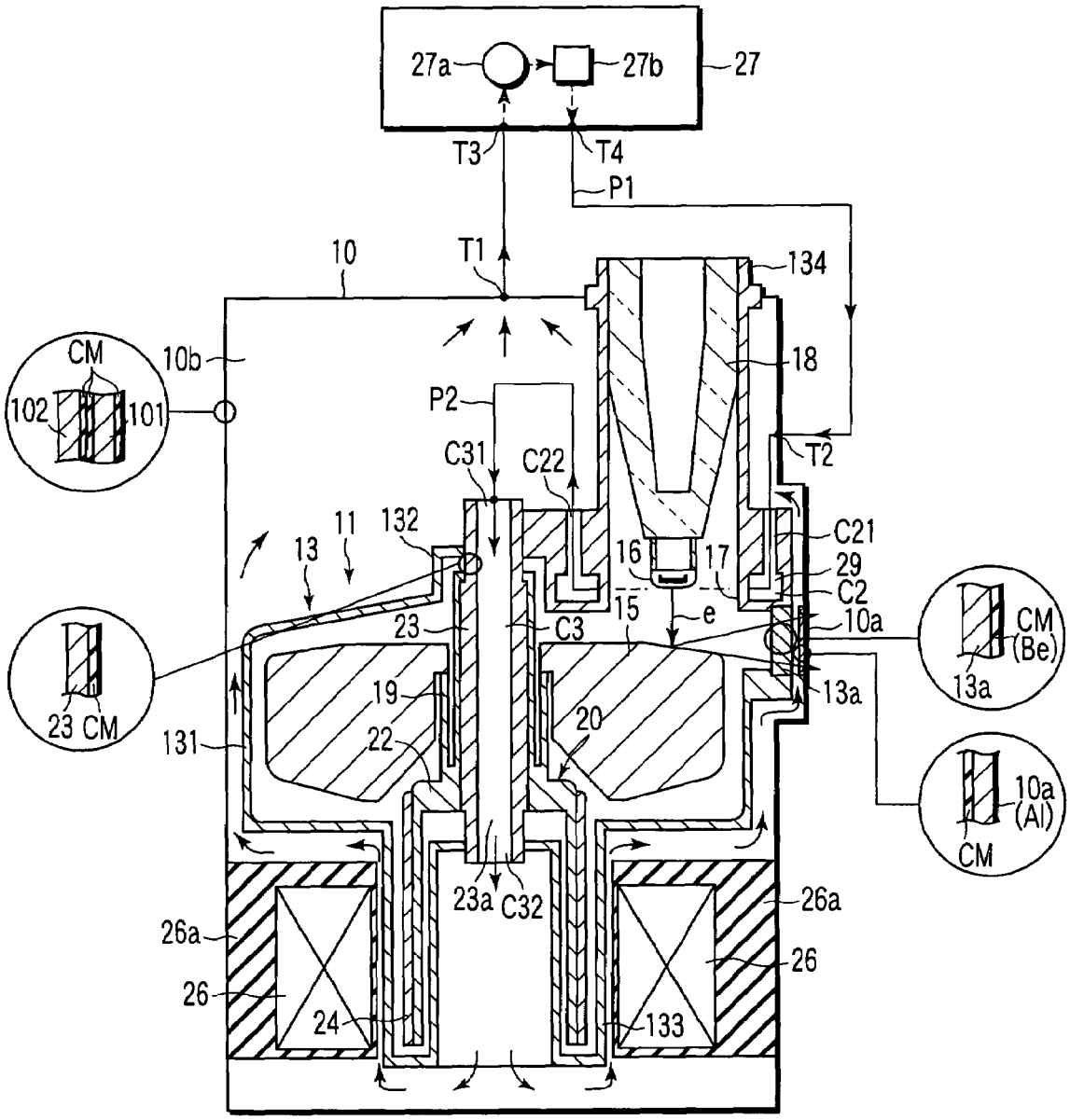
FIG. 4 schematically shows the structure of an X-ray apparatus according to a fourth embodiment of the invention.

As is shown in FIG. 4, like the second embodiment, the third cooling path C3 is formed by a through-hole 23*a* that linearly penetrates the stationary member 23. The stationary member 23 is a hollow rod-like member, and has both ends opened. The through-hole 23*a* includes an inlet C31 for introducing the water-based coolant into the third cooling path C3, and an outlet C32 for draining the water-based coolant from the third cooling path C3. The inlet C31 is provided at one end portion (on the cathode-containing portion 134 side in this example) of the stationary member 23. The outlet C32 is provided at the other end portion (on the cylindrical rotor 24 side in this example) of the stationary member 23.

Pipes P1 and P2 connect, respectively, the cooling unit 27 and inlet C21, and the outlet C22 and inlet C31. The outlet C32 drains the antifreeze liquid, which is introduced into the third cooling path C3, into the inner space 10*b* of the housing 10. The connection part T1 between the hose and the housing 10 functions as an outlet for outputting the antifreeze liquid from the inner space 10*b* of the housing 10 to the cooling unit 27 via the hose.

A return path of the antifreeze liquid is formed between the inner space 10*b* of the housing 10 and the cooling unit 27 (i.e. between the connection parts T1 and T3). Thus, the inner space 10*b*, which accommodates the rotation-anode type X-ray tube 11, is filled with the antifreeze liquid that is the water-based coolant.

A circulation path of the antifreeze liquid is so formed as to include the pipes P1 and P2, the second cooling path C2, the third cooling path C3, and the return path. For the convenience of depiction, the pipe P1 is partly depicted on the outside of the housing 10. Normally, however, all the pipes are provided within the housing 10.

On the other hand, like the third embodiment, the stator 26, together with the rotation-anode type X-ray tube 11, is accommodated within the housing 10, and an anti-rust coating film 26*a* is formed (by molding) on at least a part of the surface of the stator 26. Thereby, the periphery of the stator 26 does not come in contact with the water-based coolant, and degradation in electrical insulation can be prevented.

The X-ray apparatus with the above-described structure is configured such that the antifreeze liquid coming out of the outlet C22 is introduced into the inlet C31 via the pipe P2 and cools the stationary member 23 while passing through the through-hole 23*a* (third cooling path C3) that extends within the stationary member 23 in one direction (i.e. direction from the cathode-containing portion 134 side to the cylindrical rotor 24 side).

In the fourth embodiment, like the third embodiment, at least a part of the surface of metallic components is coated with a coating member to prevent contacting with the water-based coolant. In the fourth embodiment, the metallic components that come in contact with the water-based coolant are those constituting the circulation path, for instance, the circulation pump 27*a*, heat exchanger 27*b*, pipes P1 to P4, cooling paths C1 to C3, connection parts T1 to T4, the inner surface of the housing 10, the outer surface of the vacuum envelope 13, X-ray output window 10*a* and X-ray output window 13*a*. At least a part thereof is coated with a coating member. As in the third embodiment, the coating member CM can be formed of an organic coating or an inorganic coating. Therefore, according to the X-ray apparatus of the fourth embodiment, the same advantages as with the third embodiment can be obtained.

Fifth Embodiment

An X-ray apparatus according to a fifth embodiment of the present invention is described. The structural parts common to those in the third embodiment are denoted by like reference numerals, and a detailed description is omitted.

Figure 5:
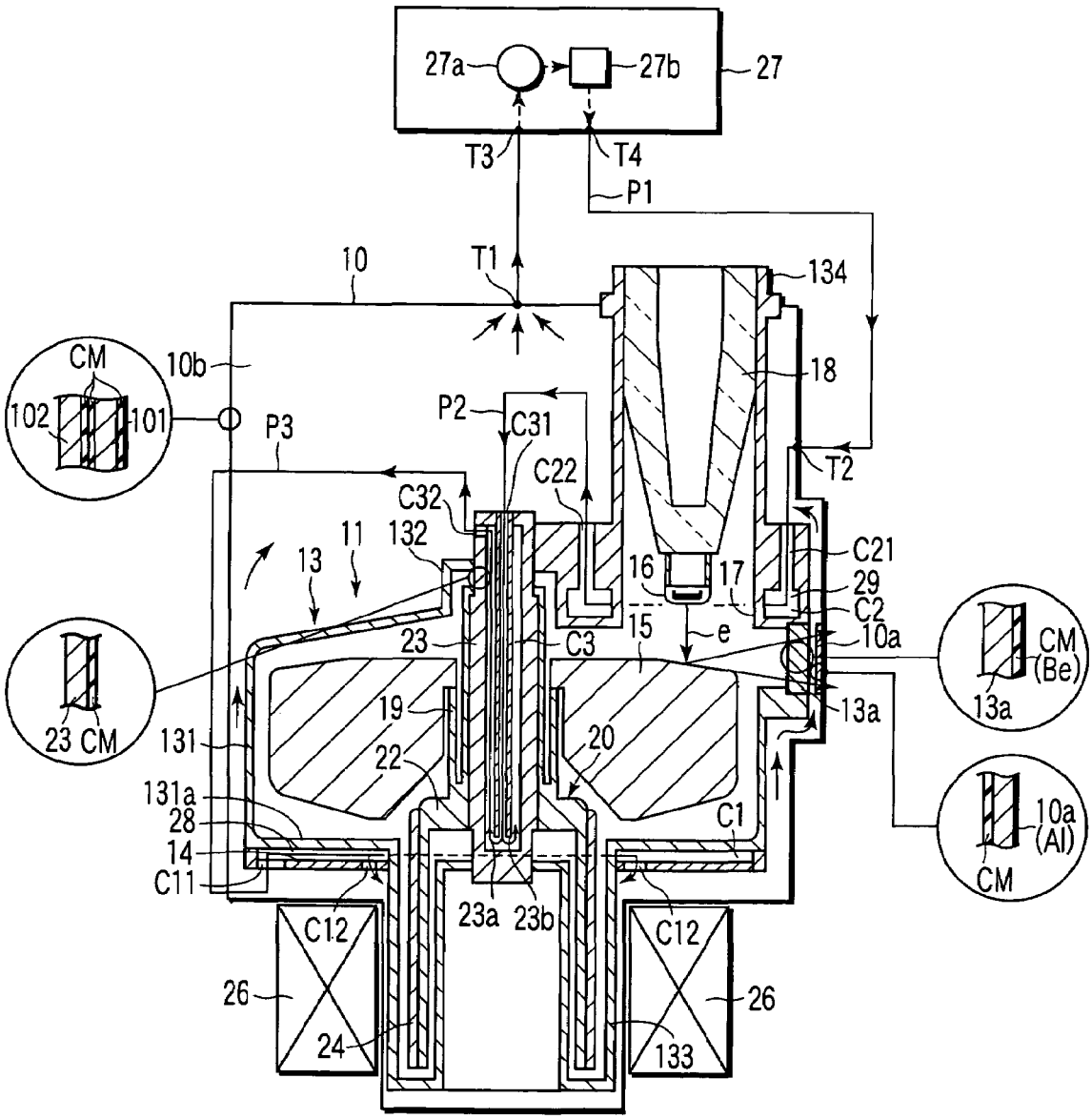
FIG. 5 schematically shows the structure of an X-ray apparatus according to a fifth embodiment of the invention.

As is shown in FIG. 5, the X-ray apparatus according to the fifth embodiment has basically the same structure as the X-ray apparatus according to the third embodiment shown in FIG. 3. The fifth embodiment, however, differs from the third embodiment in that the stator 26 is disposed outside the housing 10. Since the stator 26 does not come in contact with the water-based coolant, degradation in electrical insulation can be prevented. Unlike the third embodiment, there is no need to form an anti-rust coating film on the surface of the stator 26. Thus, the cost can be reduced and the size of the entire apparatus can advantageously be reduced. The stator 26 with this structure cannot be cooled by the coolant, but it can be cooled by making use of outside air.

In the fifth embodiment, like the third embodiment, at least a part of the surface of metallic components is coated with a coating member to prevent contacting with the water-based coolant. In the fifth embodiment, like the third embodiment, the metallic components that come in contact with the water-based coolant are those constituting the circulation path, for instance, the circulation pump 27*a*, heat exchanger 27*b*, pipes P1 to P4, cooling paths C1 to C3, connection parts T1 to T4, the inner surface of the housing 10, the outer surface of the vacuum envelope 13, X-ray output window 10*a* and X-ray output window 13*a*. At least a part thereof is coated with a coating member. As in the third embodiment, the coating member CM can be formed of an organic coating or an inorganic coating. Therefore, according to the X-ray apparatus of the fifth embodiment, the same advantages as with the third embodiment can be obtained.

Sixth Embodiment

An X-ray apparatus according to a sixth embodiment of the present invention is described. The structural parts common to those in the fourth embodiment are denoted by like reference numerals, and a detailed description is omitted.

Figure 6:
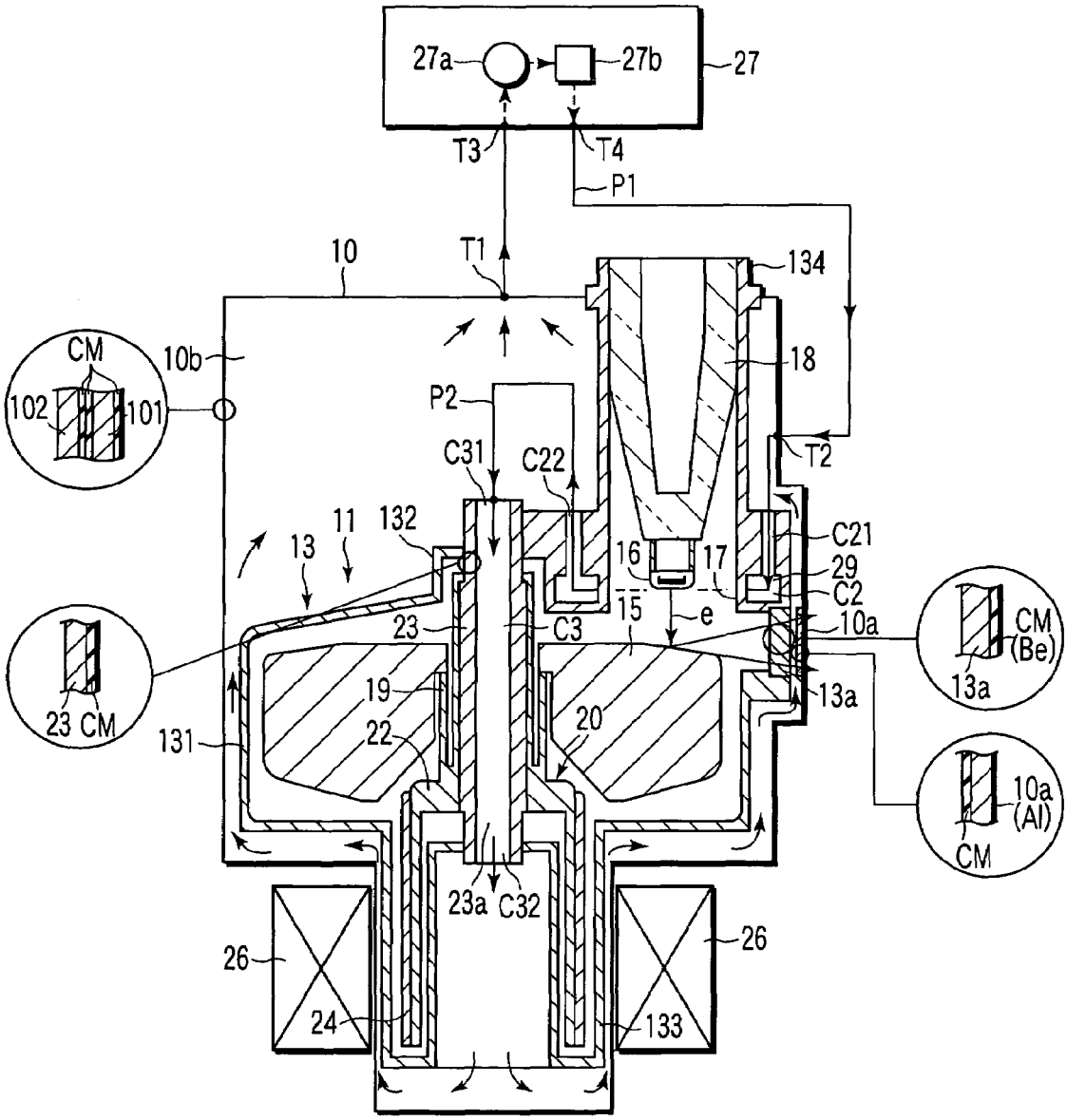
FIG. 6 schematically shows the structure of an X-ray apparatus according to a sixth embodiment of the invention.

As is shown in FIG. 6, the X-ray apparatus according to the sixth embodiment has basically the same structure as the X-ray apparatus according to the fourth embodiment shown in FIG. 4. The sixth embodiment, however, differs from the fourth embodiment in that the stator 26 is disposed outside the housing 10. Since the stator 26 does not come in contact with the water-based coolant, degradation in electrical insulation can be prevented. Unlike the fourth embodiment, there is no need to form an anti-rust coating film on the surface of the stator 26. Thus, the cost can be reduced and the size of the entire apparatus can advantageously be reduced. The stator 26 with this structure cannot be cooled by the coolant, but it can be cooled by making use of outside air.

In the sixth embodiment, like the third embodiment, at least a part of the surface of metallic components is coated with a coating member to prevent contacting with the water-based coolant. In the sixth embodiment, like the third embodiment, the metallic components that come in contact with the water-based coolant are those constituting the circulation path, for instance, the circulation pump 27*a*, heat exchanger 27*b*, pipes P1 to P4, cooling paths C1 to C3, connection parts T1 to T4, the inner surface of the housing 10, the outer surface of the vacuum envelope 13, X-ray output window 10*a* and X-ray output window 13*a*. At least a part thereof is coated with a coating member. As in the third embodiment, the coating member CM can be formed of an organic coating or an inorganic coating. Therefore, according to the X-ray apparatus of the sixth embodiment, the same advantages as with the third embodiment can be obtained.

The present invention is not limited to the above-described embodiments. At the stage of practicing the invention, various embodiments may be made by modifying the structural elements without departing from the spirit of the invention. Structural elements disclosed in the embodiments may properly be combined, and various inventions may be made. For example, some structural elements may be omitted from the embodiments. Moreover, structural elements in different embodiments may properly be combined.

For example, in the first and second embodiments, the insulating oil is used as the first coolant that fills the inside of the housing, and the antifreeze liquid, which has a higher heat transfer efficiency than the first coolant, is used as the second coolant that fills the circulation path. However, the combination of the first coolant and second coolant is not limited to the combination of the insulating oil and antifreeze liquid, and other combinations of coolants can be used.

Similarly, in the third to sixth embodiments, the antifreeze liquid, which has a higher heat transfer efficiency than the insulating oil, is used as the coolant that fills the housing and circulation path. However, the coolant, which is applicable to these embodiments, is not limited to the antifreeze liquid, and other coolants are usable.

In the first to sixth embodiments, the dynamic-pressure slide bearing is used in the rotational support mechanism that rotatably supports the anode target. However, in this invention, an antifriction bearing using a ball bearing, or a magnetic bearing can be used. Even in cases where these bearings are used, if coupling between the stator coil and the rotary driving unit of the rotary member is deficient or high-speed rotation is performed, the temperature of the coil may rise. In these cases, the same advantageous effects as in the above embodiments can be obtained by adopting the structures of these embodiments.

Figure 7:
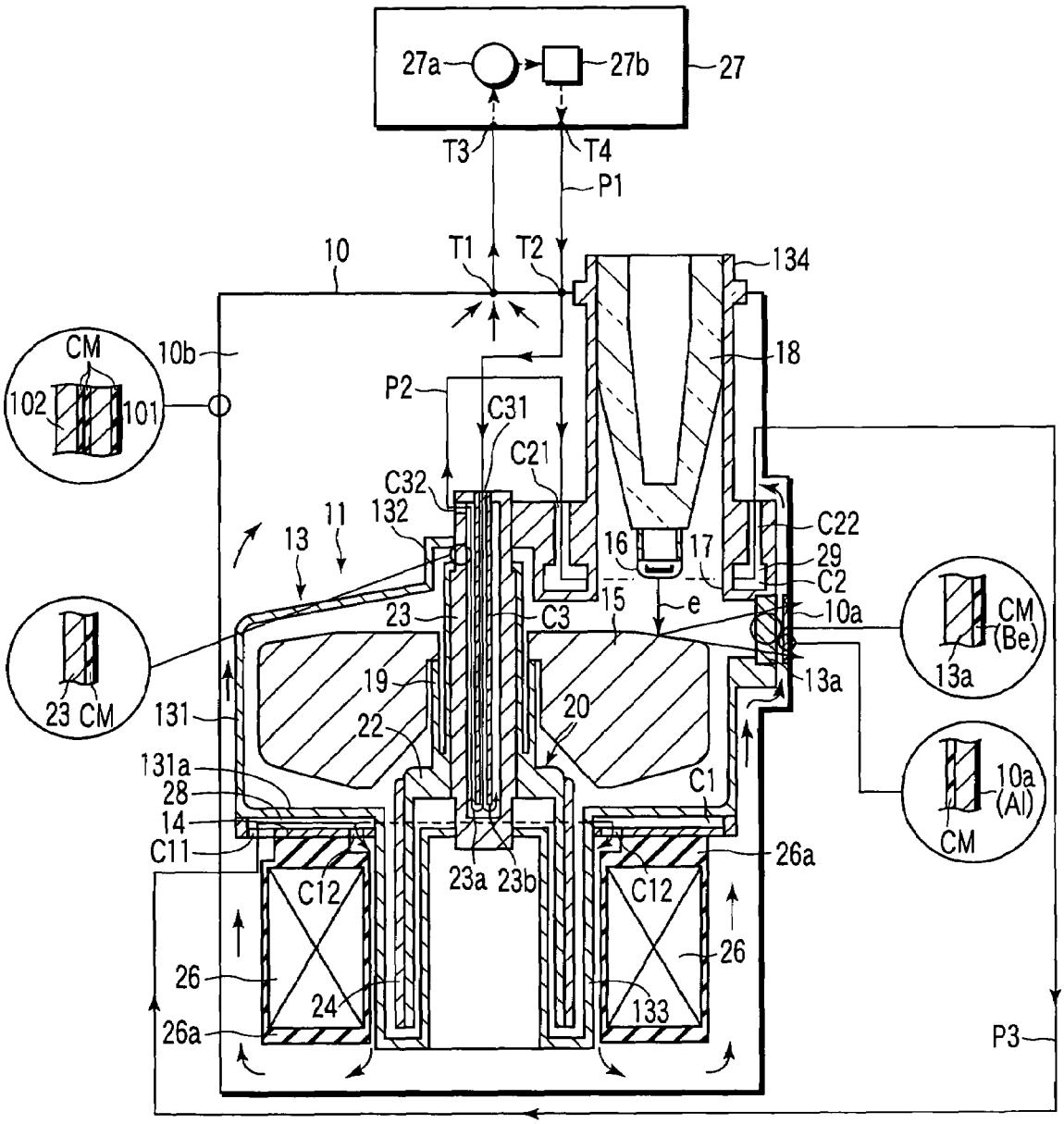
FIG. 7 schematically shows the structure of an X-ray apparatus according to a modification.

It is desirable that the water-based coolant, which is fed from the cooling unit, be introduced into the part that is to be preferentially cooled, such as a part with low durability to heat or a part with high heat production. For example, in a modification of the third embodiment, as shown in FIG. 7, pipes P1, P2 and P3 may connect, respectively, the cooling unit 27 and inlet C31, the outlet C32 and inlet C21, and the outlet C22 and inlet C11.

The outlet C12 drains the antifreeze liquid, which is introduced into the first cooling path C1, into the inner space 10*b* of the housing 10. The connection part T1 between the hose and the housing 10 functions as an outlet for outputting the antifreeze liquid from the inner space 10*b* of the housing 10 to the cooling unit 27 via the hose. In short, a return path of the antifreeze liquid is formed between the inner space 10*b* of the housing 10 and the cooling unit 27 (i.e. between the connection parts T1 and T3). Thus, the inner space 10*b*, which accommodates the rotation-anode type X-ray tube 11, is filled with the antifreeze liquid that is the water-based coolant. In this way, a circulation path of the antifreeze liquid is so formed as to include the pipes P1, P2 and P3, the first cooling path C1, second cooling path C2, third cooling path C3, and the return path.

In this case, the antifreeze liquid, which is fed out of the heat exchanger 27*b* of the cooling unit 27, is introduced into the inlet C31 via the pipe P1 and cools the stationary member 23 while passing through the cavity 23*a* (third cooling path C3) that is so formed as to permit reciprocal flow of the antifreeze liquid within the stationary member 23. The antifreeze liquid coming out of the outlet C32 is introduced into the inlet C21 via the pipe P2 and cools the recoil electron trap 17 while passing through the annular space 29 (second cooling path C2). The antifreeze liquid coming out of the outlet C22 is introduced into the inlet C11 via the pipe P3 and cools the large-diameter portion 131 of the vacuum envelope 13 while passing through the discoidal space 28 (first cooling path C1). The antifreeze liquid, which is drained from the outlet C12, is returned to the cooling unit 27 via the pipe P4.

According to this structure, it is possible to provide an X-ray apparatus wherein the part that is to be preferentially cooled is efficiently cooled, and high reliability is secured for a long time. Although the modification of the first embodiment alone is described, similar structures can be applied to the other embodiments.

According to the above-described X-ray apparatus, the parts with high temperatures are cooled by using the coolant with high heat transfer efficiency. Thereby, a good heat radiation performance can be realized. Hence, it is possible to provide an X-ray apparatus which can improve heat radiation characteristics and can have high reliability for a long time.

As has been described above, the present invention can provide an X-ray apparatus which can improve heat radiation characteristics and can have high reliability for a long time.

What is claimed is:

1. An X-ray apparatus comprising:

a rotation-anode type X-ray tube configured such that a rotatable anode target and a cathode, disposed opposite to the anode target, are accommodated within a vacuum envelop;

a stator which generates an induction electromagnetic field for rotating the anode target;

a housing which accommodates and holds at least the rotation-anode type X-ray tube;

a circulation path, provided near at least a part of the rotation-anode type X-ray tube, through which a water-based coolant is circulated; and a cooling unit including a circulation pump, which is provided at a position along the circulation path and forcibly feeds the water-based coolant, and a radiator which radiates heat of the water-based coolant, wherein the circulation path includes a path formed between an inner surface of the housing, having at least a part which is formed of lead, and the vacuum envelope, having a surface that has at least a part of which is formed of an iron alloy, and wherein the inner surface of the housing is coated with a coating member to prevent contacting with the water-based coolant, and wherein the coating member is an organic coating.

2. The X-ray apparatus according to claim 1, wherein the organic coating is one selected from an epoxy resin, a tar epoxy resin, a polyimide resin, an acrylic resin, a fluorocarbon resin, a silicone resin, a polyurethane resin, a polyamide resin, an unsaturated polyester resin and a polyvinyl chloride resin, or a mixture resin essentially comprising with at least one of these mentioned resins.

* * * * *